US009452877B2

(12) United States Patent
Grosskopf

(10) Patent No.: US 9,452,877 B2
(45) Date of Patent: Sep. 27, 2016

(54) CHILD-RESISTANT PACKAGING CONTAINER AND BLANK

(71) Applicant: Colbert Packaging Corporation, Lake Forest, IL (US)

(72) Inventor: Glenn A. Grosskopf, Lake Zurich, IL (US)

(73) Assignee: Colbert Packaging Corporation, Lake Forest, IL (US)

( * ) Notice: Subject to any disclaimer, the term of this patent is extended or adjusted under 35 U.S.C. 154(b) by 267 days.

(21) Appl. No.: 14/494,221

(22) Filed: Sep. 23, 2014

(65) Prior Publication Data

US 2016/0083170 A1 Mar. 24, 2016

(51) Int. Cl.

| | |
|---|---|
| ***B65D 83/04*** | (2006.01) |
| ***A61J 1/03*** | (2006.01) |
| *B65D 77/04* | (2006.01) |

(52) U.S. Cl.

CPC ..... *B65D 83/0463* (2013.01); *A61J 1/035* (2013.01); *B65D 77/0413* (2013.01); *B65D 2215/02* (2013.01)

(58) Field of Classification Search

CPC ..... B65D 83/0463; B65D 2215/02; B65D 2215/04; B65D 2215/06; B65D 2585/56; A61J 1/035

USPC ..... 206/1.5, 530–539, 468; 229/125.125

See application file for complete search history.

(56) References Cited

U.S. PATENT DOCUMENTS

| | | | |
|---|---|---|---|
| 3,031,070 | A | 4/1962 | Mulder |
| 3,888,350 | A | 6/1975 | Horvath |
| 4,007,828 | A | 2/1977 | Mayled |
| 4,113,098 | A | 9/1978 | Howard |
| 4,120,400 | A | 10/1978 | Kotyuk |
| 4,174,034 | A | 11/1979 | Hoo |
| 4,192,422 | A | 3/1980 | Kotyuk |
| 4,284,204 | A | 8/1981 | Carey, Jr. |
| 4,364,488 | A | 12/1982 | Anjou |
| 4,848,582 | A | 7/1989 | Levasseur et al. |
| 5,080,222 | A | 1/1992 | McNary |

(Continued)

FOREIGN PATENT DOCUMENTS

| | | | |
|---|---|---|---|
| GB | 2042476 | A | 9/1980 |
| WO | 9738919 | A1 | 10/1997 |

(Continued)

OTHER PUBLICATIONS

United States Patent and Trademark Office, International Search Report and Written Opinion of the International Searching Authority, issued in corresponding International Application No. PCT/US2015/051161 on Dec. 11, 2015.

*Primary Examiner* — Luan K Bui

(74) *Attorney, Agent, or Firm* — Patzik, Frank & Samotny Ltd.

(57) ABSTRACT

A childproof and senior friendly packaging container having a housing that defines a chamber for removably receiving a blister card or sheet. The blister card includes a blister or node on its end that is designed to engage a pair of slots within the sleeve of the housing to retain the blister card within the housing in a stored position and an extended position. The node may include a sloped rear surface to allow the blister card to be returned to a stored position. Squeezing the sides of the housing about the interior slot biases both the top panel of the housing and the panels defining the slot to release the node from the slot to allow the blister card to be withdrawn.

18 Claims, 13 Drawing Sheets

(56) References Cited

U.S. PATENT DOCUMENTS

| | | | | |
|---|---|---|---|---|
| 5,082,137 | A | 1/1992 | Weinstein | |
| 5,275,291 | A | 1/1994 | Sledge | |
| 5,878,887 | A | 3/1999 | Parker et al. | |
| 6,047,829 | A * | 4/2000 | Johnstone | B65D 5/38 206/1.5 |
| 6,230,893 | B1 * | 5/2001 | Karow | B65D 5/38 206/1.5 |
| 6,349,831 | B1 | 2/2002 | Buss | |
| 6,412,636 | B1 | 7/2002 | Jones et al. | |
| 6,491,211 | B1 | 12/2002 | Evans et al. | |
| 6,641,031 | B2 | 11/2003 | Evans et al. | |
| 6,752,272 | B2 | 6/2004 | Jones et al. | |
| 6,848,580 | B2 | 2/2005 | Paliotta et al. | |
| 6,874,636 | B2 | 4/2005 | Paliotta et al. | |
| 7,090,079 | B2 | 8/2006 | Ehrlund | |
| 7,201,274 | B2 | 4/2007 | Paliotta et al. | |
| 7,325,689 | B2 | 2/2008 | Buss | |
| 7,389,875 | B2 | 6/2008 | Sandberg et al. | |
| 7,588,149 | B2 | 9/2009 | Gelardi | |
| 7,591,372 | B2 | 9/2009 | Gelardi et al. | |
| 7,617,935 | B2 | 11/2009 | Reilley et al. | |
| 7,658,287 | B2 | 2/2010 | Hession | |
| 7,708,142 | B2 | 5/2010 | Ehrlund | |
| 7,726,481 | B2 | 6/2010 | Grosskopf | |
| 7,798,329 | B2 | 9/2010 | Gelardi | |
| 7,802,677 | B2 | 9/2010 | Williams | |
| 7,845,496 | B2 | 12/2010 | Hession | |
| 8,066,121 | B2 | 11/2011 | Sack et al. | |
| 8,132,671 | B2 | 3/2012 | Hession | |
| 8,205,752 | B2 * | 6/2012 | Sack | B65D 83/04 206/1.5 |
| 8,220,634 | B2 | 7/2012 | Mowery | |
| 8,365,916 | B2 | 2/2013 | Gelardi | |
| 8,602,218 | B2 | 12/2013 | Grosskopf | |
| 2006/0283760 | A1 | 12/2006 | Nivala | |
| 2007/0068843 | A1 * | 3/2007 | Hession | B65D 5/0227 206/538 |
| 2007/0272586 | A1 * | 11/2007 | Hession | B65D 5/38 206/532 |
| 2009/0184022 | A1 * | 7/2009 | Coe | B65D 83/0463 206/531 |
| 2009/0301924 | A1 | 12/2009 | Rondeau | |
| 2010/0084308 | A1 * | 4/2010 | Rigby | B65D 83/0463 206/531 |
| 2010/0243509 | A1 | 9/2010 | Gelardi | |
| 2011/0114512 | A1 * | 5/2011 | Gelardi | B65D 83/0463 206/1.5 |
| 2012/0012497 | A1 | 1/2012 | Weston et al. | |
| 2012/0037517 | A1 * | 2/2012 | Grosskopf | A61J 1/035 206/1.5 |
| 2012/0181204 | A1 * | 7/2012 | Bogdziewicz, III | B65D 83/0463 206/468 |
| 2012/0267261 | A1 | 10/2012 | Gelardi | |
| 2013/0068651 | A1 | 3/2013 | Gelardi et al. | |

FOREIGN PATENT DOCUMENTS

| | | | |
|---|---|---|---|
| WO | 2011038052 | A1 | 3/2011 |
| WO | 2013151806 | A1 | 10/2013 |

* cited by examiner

CHILD-RESISTANT PACKAGING CONTAINER AND BLANK

FIELD OF THE INVENTION

This invention relates in general to packaging containers and, more particularly, to packaging containers that are child-resistant and senior friendly.

BACKGROUND OF THE INVENTION

The number of available consumer pharmaceuticals continues to grow for use in the diagnosis, cure, treatment and/or prevention of diseases or injuries. In fact, the use of pharmaceuticals is so prevalent that there are very few households where they are not present. Due to the chemical nature of many of these medicines, any unintended uses or overdoses may have very damaging or lethal consequences. This is especially true with children who do not understand or appreciate the dangers involved. Accordingly, there has been a need to make the packaging childproof. However, because many people who use pharmaceuticals are elderly and may have lost some of their physical strength and/or coordination, it is also important that any such packaging also be readily usable by senior citizens.

Therefore, there is a need to produce a packaging container that allows senior citizens and other intended users, but not children, to access the contents of the packaging.

SUMMARY OF THE INVENTION

The present invention is an improvement over the prior product packaging in the way that the packaging container secures the contents to prevent access from children, while still permitting a senior citizen to access the contents. In particular, the packaging container securely retains a slidable blister card or sheet within a housing that does not allow access to the contents until multiple steps are performed.

In one embodiment, the packaging container includes a housing and a blister card or sheet. The housing of the packaging container may be formed from a blank that is integrally formed and, when assembled, defines a housing that includes an interior sleeve or chamber for receiving the blister card or sheet. The housing may comprise a paper-based material, although it is appreciated that other materials may be used and not depart from the scope of the present invention.

The blank may include a bottom panel, a top panel, side panels, end panels, an interior panel, a sleeve top panel, reinforcing panels and node retaining panels. In order to form the housing, the reinforcing members are folded over the bottom panel and the sleeve top panel. The node retaining panels, which are located adjacent one end of the interior panel and have an opening defining a slot, may then be folded over themselves and the interior panel. The sleeve top panel, which includes slots or openings proximate both ends, may then be folded over the interior panel, thereby creating retaining slots in the interior sleeve proximate both ends of the housing. The interior panel can then be folded over the reinforcing panel and bottom panel, and the top panel may be folded over and attached to the back of the interior panel to create the housing.

A blister sheet or card having a blister or node proximate its back end may then be inserted into the housing until the node engages the slot on the sleeve top panel and the node retaining panels. In order to release the blister card, a user squeezes the sides of the housing about the slot, which acts to bow the top of the housing and the interior and node retaining panels in opposite directions to free the node from the slot. While the sides are squeezed, the blister card may then be grabbed at its front end to begin withdrawing the blister card from the sleeve of the housing. The blister card may be withdrawn until the node engages the slot at the opposite end of the sleeve top panel, thereby preventing the blister card from being removed from the housing. Once done with the blister card (e.g., the medicine has been removed from its blisters for consumption), the blister card can be pushed into the sleeve of the housing to return to the stored position. In order to assist in returning the blister card to the stored position, the node may include a sloped rear side.

It is therefore an object of the present invention to provide a new packaging container that is child-resistant and senior-friendly.

Yet another object of the present invention is to provide a new packaging container that is better for the environment than conventional packaging containers.

Still another object of the present invention is to provide a new packaging container that is safer to open.

Yet another object of the present invention is to provide a packaging container that inhibits theft and the inadvertent opening of the packaging.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
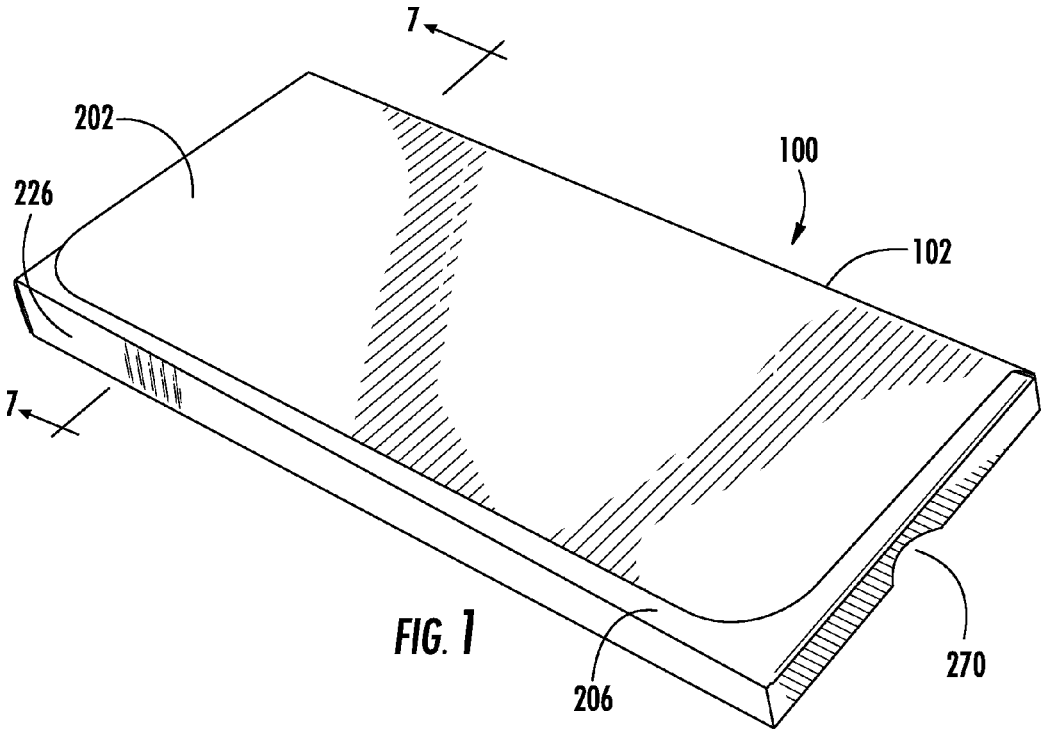
FIG. 1 is a top perspective view of one embodiment of the packaging container of the present invention.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
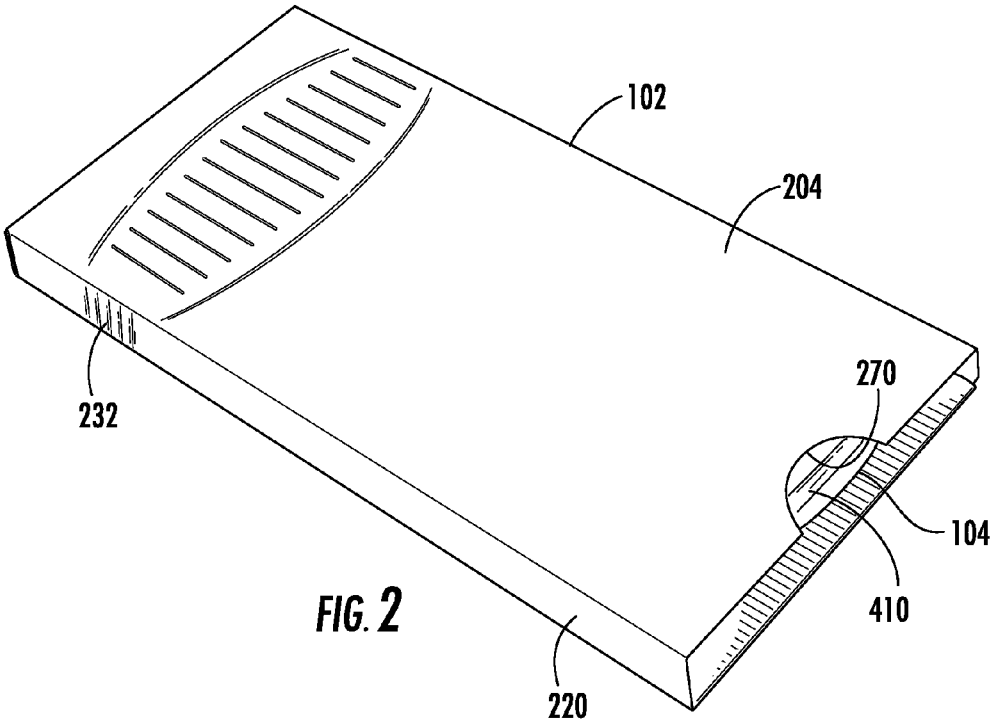
FIG. 2 is a bottom perspective view of the packaging container shown in FIG. 1.
Figure 3:
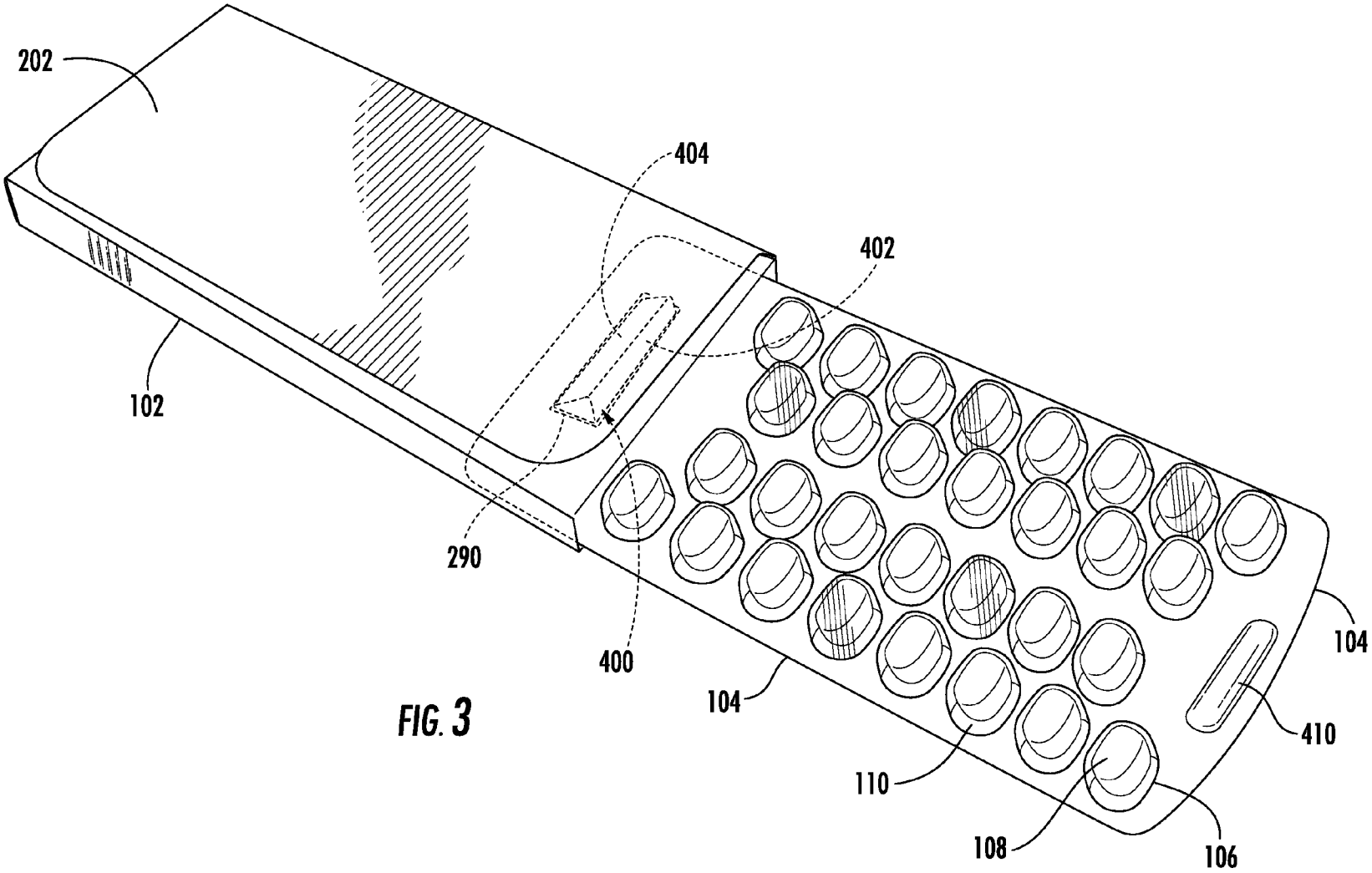
FIG. 3 is a top prospective view of the packaging container of FIG. 1 with a blister card extending outwardly therefrom.

Referring now to the drawings, and particularly to FIGS. 1 through 3, one embodiment of the improved product packaging container of the present invention, generally designated by the numeral 100, is shown having a housing 102 and a blister card or sheet 104 having a plurality of blisters or chambers 106 for storing the product 108 to be dispensed.

In order to prevent access to the pills or other products 108 to be dispensed when within the housing from children, the housing 102 is preferably made from a material that is tear-resistant. One example of a material that may be used is a SBS board coated with a laminated material having directional grains that, when criss-crossed, adds strength to the housing and protects against tearing or tampering in two directions. A suitable coating is manufactured under the trademark VALERON™ by Valeron Strength Films. While VALERON is made from a polyethylene material, other such coatings such as, but not limited to, polypropylene or polyester may be used. The material used also is preferably printable to allow for advertising, promotional or other information to be displayed on the housing. While a SBS board with a cross-laminated coating is preferred, it is appreciated that other tear-resistant materials including, but not limited to, cloth films, cloth and plastic films, heat sealable boards and other coatings, also may be used and not depart from the scope of the present invention. Examples of cloth films and cloth and plastic films include those films sold under the names SCRIM and CLAF. A corrugate stock also may be used to achieve a more rigid finished packaging product.

The packaging container is adapted to be childproof by permitting the blister sheet or card 104 to be securely retained in a stored position within the housing 102 and only releasable upon the execution of a particular series of steps that are not likely to be figured out be a child. The packaging container is also adapted to inhibit the complete removal of the blister card 104 from the housing 102 by limiting the axial movement of the blister card 104.

Figure 9:
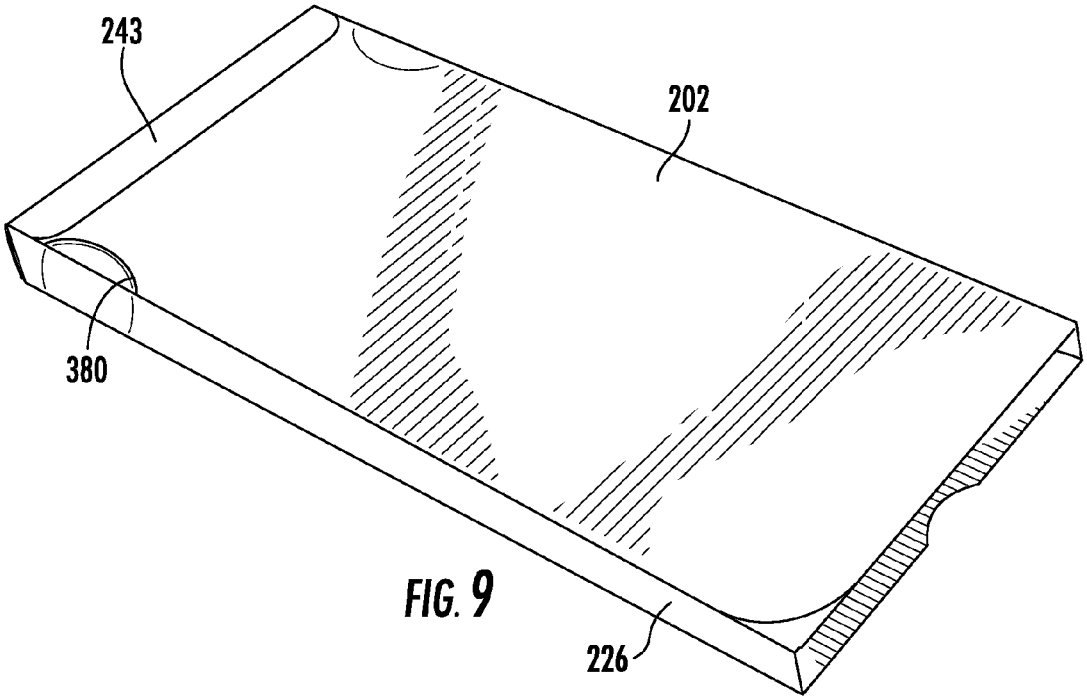
FIG. 9 is a top perspective view of a second embodiment of the packaging container of the present invention.
Figure 10:
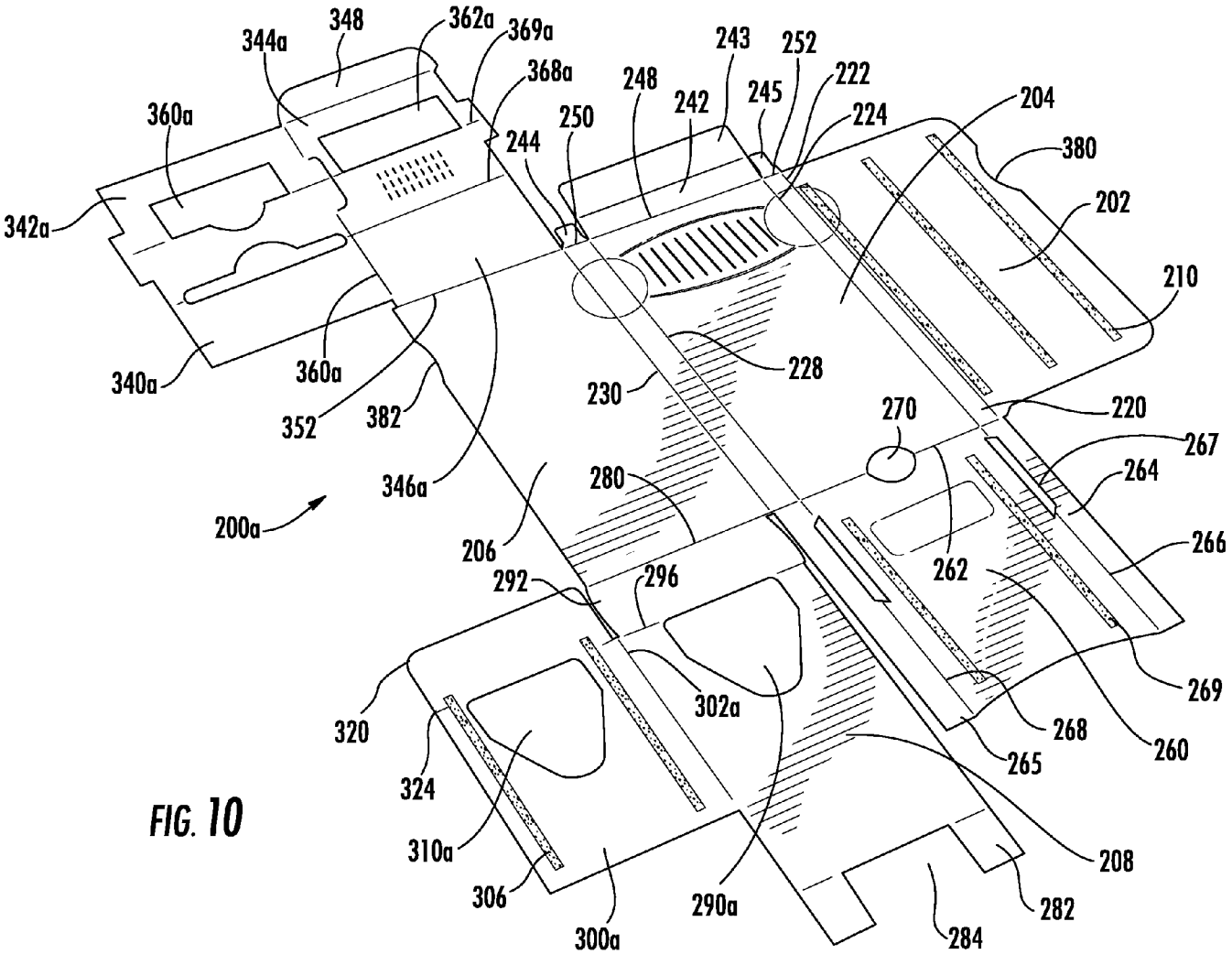
FIG. 10 is a top plan view of a second embodiment of a blank for the housing of the packaging container shown in FIG. 1.

Referring now to FIGS. 3 through 6, the housing may be formed from an integral blank 200. The blank includes a top panel 202, a bottom panel 204, an interior panel 206 and a sleeve top panel 208. A side panel 220 joins the top panel 202 and the bottom panel 204 along fold lines 222 and 224. Another side panel 226 joins the bottom panel 204 and interior panel 206 along fold lines 228 and 230. End panels 240, 242, 244 and 245 may be folded about fold lines 246, 248, 250 and 252 and joined together through adhesives or other known means to form an end to the housing. Referring to FIG. 10, the blank 200*a* may include an additional end panel 243 hingedly attached to end panel 242 that may be folded over and attached to the top panel 202, as shown in FIG. 9.

An overlapping or reinforcing panel 260 may be joined to the bottom panel 204 along fold line 262. The reinforcing panel 260 may also have side walls 264, 265 that align with side panels 220, 226 and are formed by folding the reinforcing panel 260 along fold lines 266 and 268. Referring to FIG. 10, open slots 267 may be formed along fold lines 266 and 268 to facilitate folding over of sidewalls 264, 265. The reinforcing panel may be used to add strength to the packaging. In operation, the reinforcing panel 260 may be attached to the bottom panel 204 through adhesives 269 or other known means.

A semi-circular slot 270 may be formed in the end of the bottom panel 204 and the reinforcing panel 260 to create an opening in the end of the packaging container 100, as shown in FIG. 1, to permit fingers or the like to extend into the housing 102 and grab the blister card 104 to assist in its removal from the housing 102 to dispense the pills or other contents 108.

Figure 4:
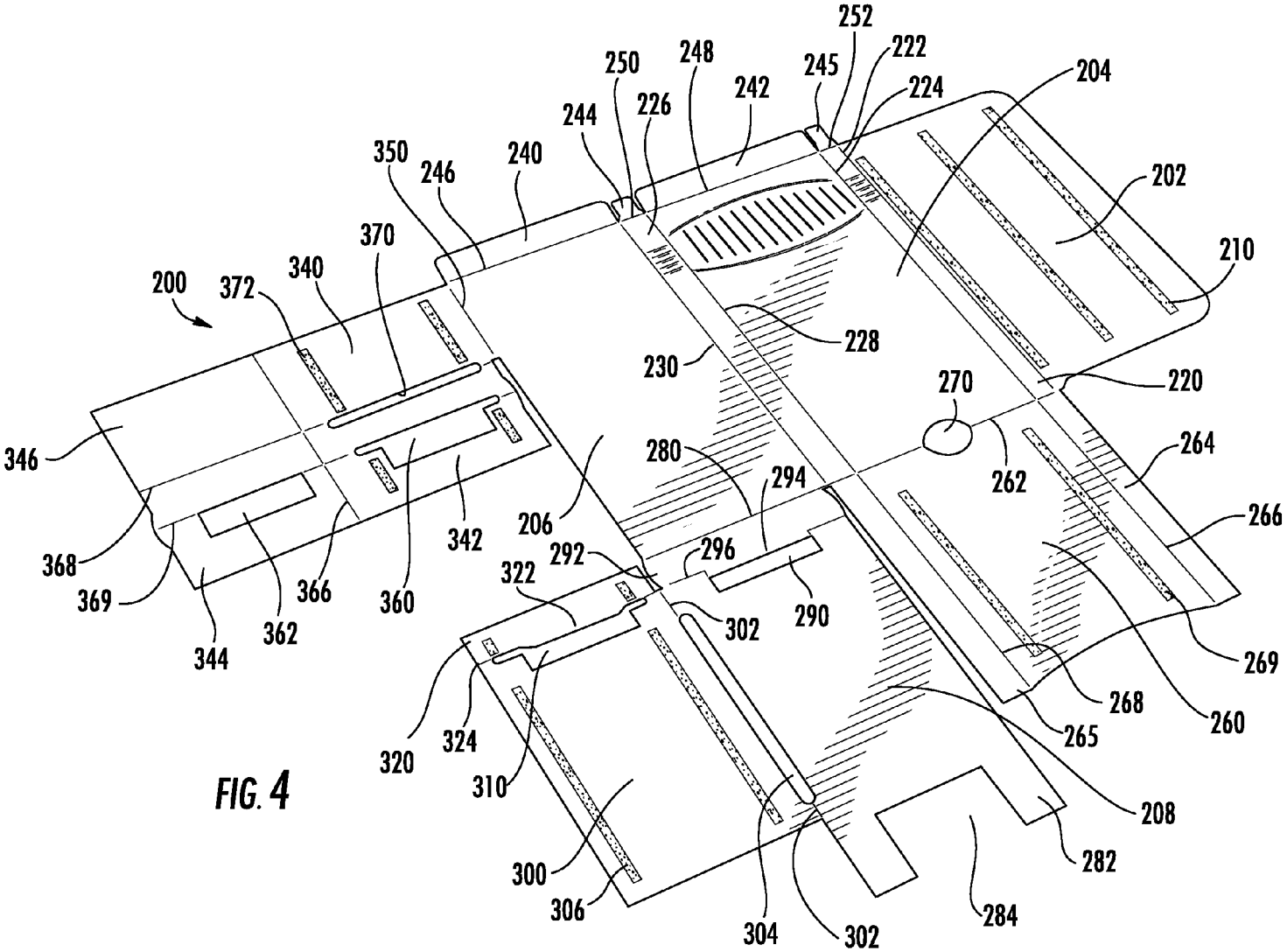
FIG. 4 is a top plan view of a blank for the housing of the packaging container shown in FIG. 1.

The sleeve top panel 208 is joined to the interior panel 206 along fold line 280. One end of the sleeve top panel 208 includes a pair of leg members 282 that define an open space 284. While a large open space is shown, it is appreciated that it may be an enclosed space such as, but not limited to, a rectangle, and not depart from the scope of the invention. A rectangular slot 290 extends transverse to the longitudinal direction of the sleeve top panel 208 at the other end proximate fold line 280. Referring to FIG. 4, sleeve top panel may include an end member 292 having a wall 294 that extends partially into the slot 290 when flat and extends angularly upwardly from the plane defined by the slot 290 when folded along fold line 296.

Sleeve overlapping or reinforcing panel 300 may be folded over sleeve top panel 208 about fold line 302 and open slot 304 and attached to the sleeve top panel 208 by adhesive 306 or other known means. Slot 310 is located on the sleeve reinforcing panel 300 such that it at least partially overlaps with slot 290 on the sleeve top panel 208 when the panels 208, 300 are connected together. The end of the sleeve reinforcing panel 300 may include an end member 320 having a wall 322 that extends partially into the slot 310 when flat and extends angularly upwardly from the plane defined by the slot 310 when folded along fold line 324. However, it is appreciated that end members 292, 320 may not include a wall as shown in FIG. 10. It is further appreciated that end members 292,320 may be larger (as shown in FIG. 10) to position the panels and slot at a higher position within the sleeve for engaging the blister or node 400 of blister card 104. While slots 290, 310 are shown as being substantially rectangular in shape, it is appreciated that they may be of a variety of sizes and shapes for receiving a corresponding node 400 therein. For example, referring to FIG. 10, slots 290*a* and 310*a* may include a rectangular base and a domed or curved top section.

Figure 5A:
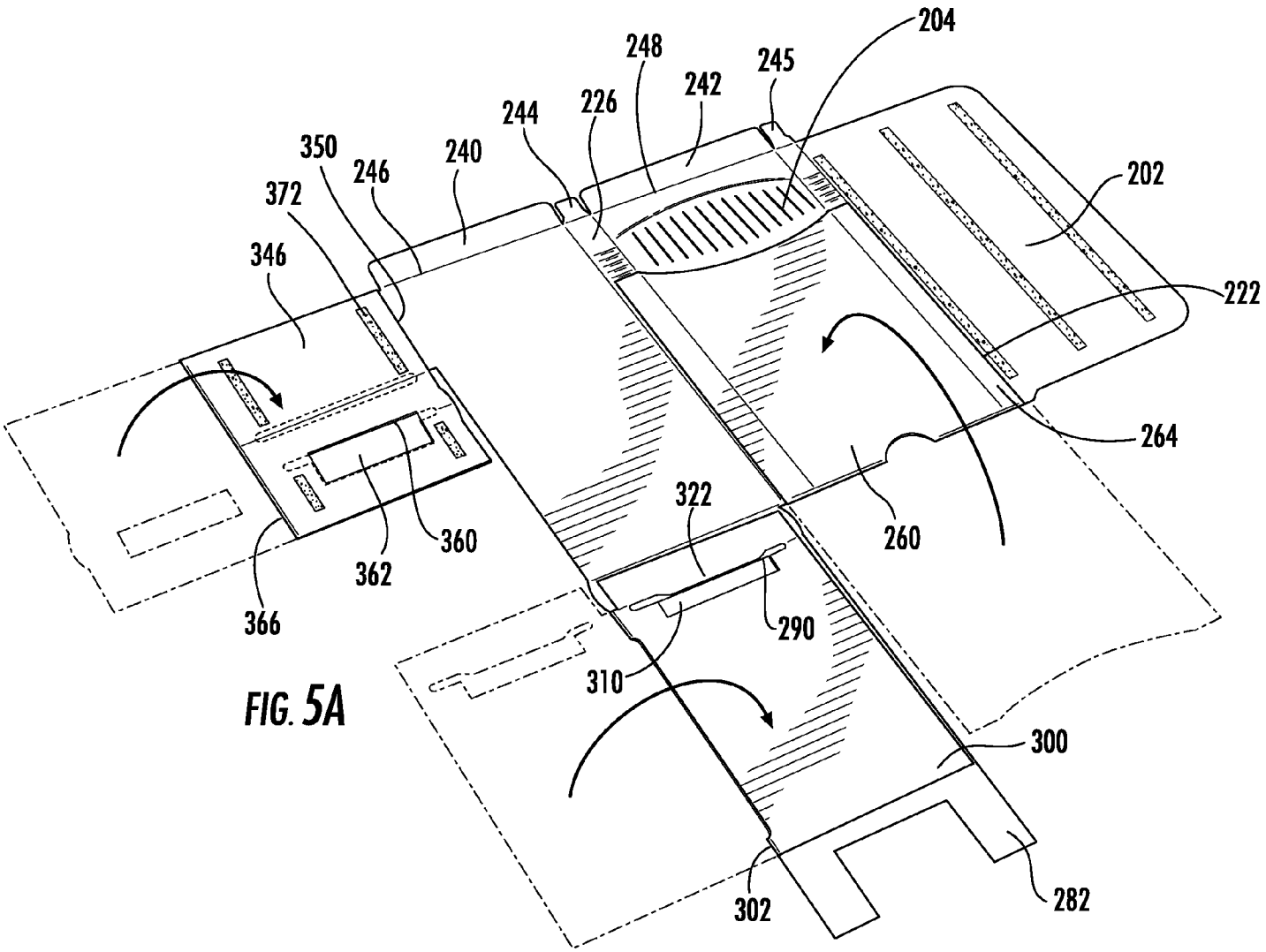
FIG. 5A is a top plan view of the blank for the housing of the packaging container shown in FIG. 4 with the reinforcing panel folded onto the housing bottom panel and the sleeve reinforcing panel folded over the sleeve top panel, and the node retaining panels folded over upon themselves.
Figure 5B:
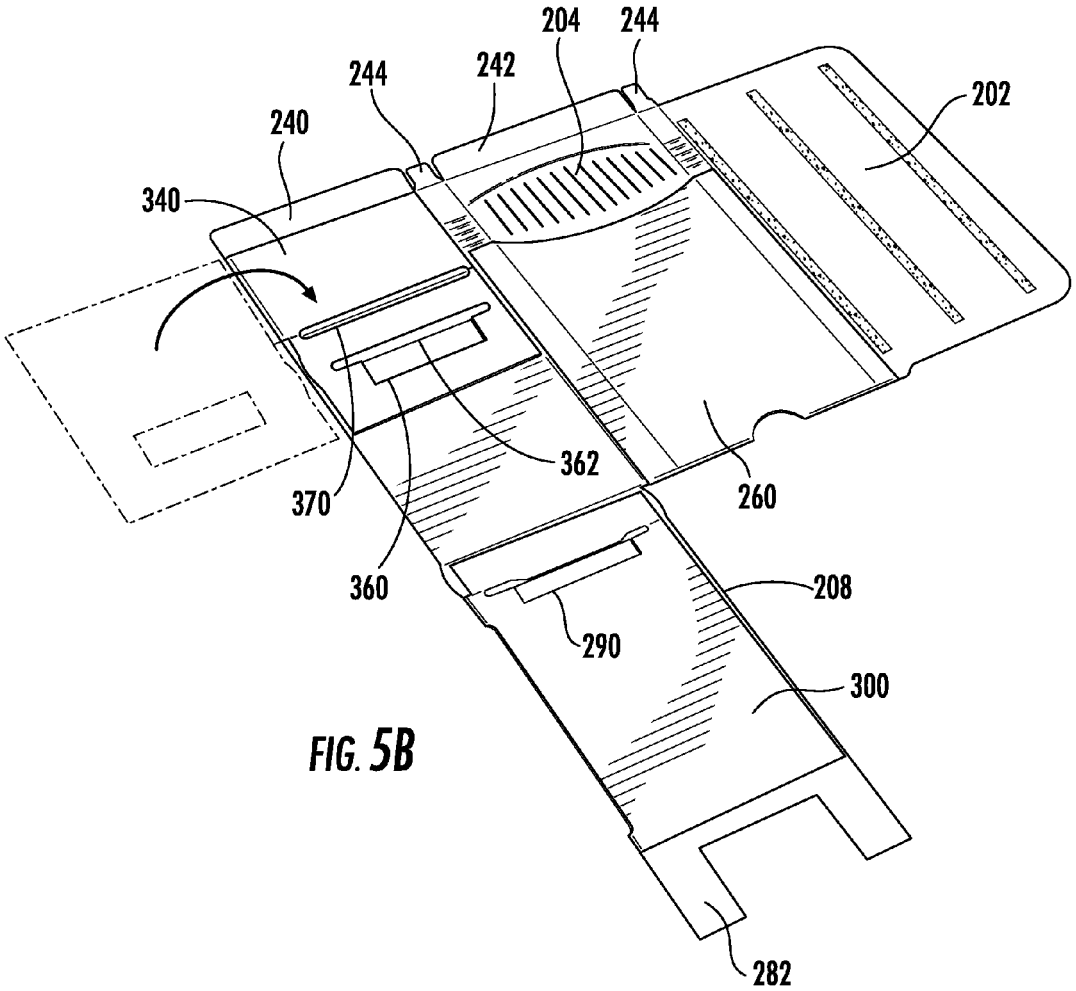
FIG. 5B is a top plan view of the blank for the housing of the packaging container shown in FIG. 4 with the node retaining panels folded over the interior panel.
Figure 6:
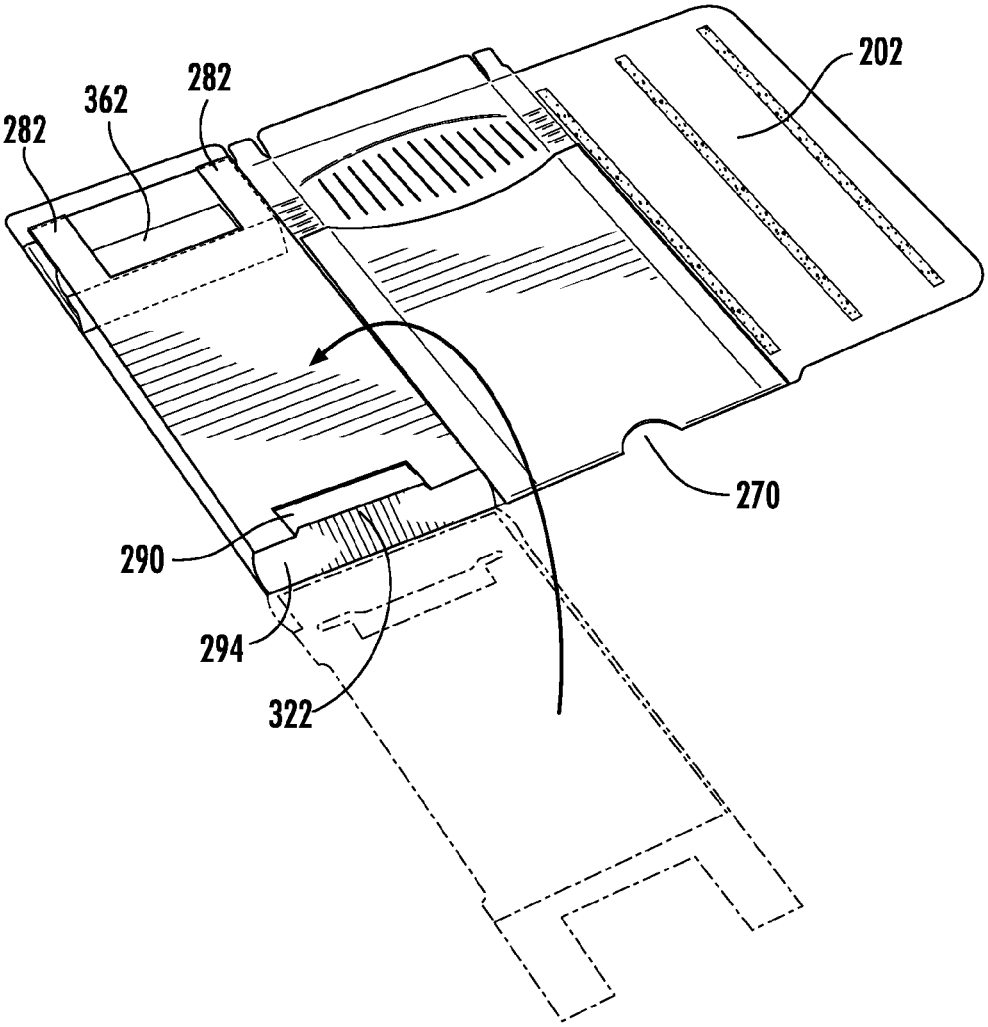
FIG. 6 is a top plan view of the blank for the housing of the packaging container shown in FIG. 4 with the sleeve top panel folded over the interior panel and the node retaining panels.

Node retaining panels 340, 342, 344 and 346 may be attached to interior panel 206 along fold line 350, which in FIG. 5A, is shown as connecting panel 340 and the interior panel 206. Panels 342 and 344 include slots 360 and 362 that are arranged to overlap when the panels are folded over one another along fold line 366. While slots 360, 362 are shown as being substantially rectangular in shape, it is appreciated that they may be of a variety of sizes and shapes for receiving a corresponding node 400 therein. The panels also include fold line 368 and slot 370 to permit the panels 342 and 344 to be folded over panels 340 and 346. Fold line 368 may also be perforated or missing between panels 344 and 346. The panels may be connected together using adhesives 372 or other known means.

The housing 102 may be formed in the following manner. While the various parts may be attached using adhesive, it is appreciated that they may be connected and held together by using any known means. As shown in FIG. 5A, reinforcing panel 260 is folded over bottom panel 204 about fold line 262 and attached thereto, while reinforcing panel 300 is folded over sleeve top panel 208 about fold line 302 and slot 304 and attached thereto such that slot 290 and slot 310 overlap and ends of wall 294, 322 extend into the openings of the slots 290, 310. Referring again to FIG. 5A, node retaining panels 344, 346 may be folded over panels 340, 342 about fold line 366 and attached thereto such that slots 360, 362 at least partially overlap to define a slot.

The node retaining panels 340, 342, 344, 346 may be further folded about fold line 368, fold line 269 and slot 370, and over interior panel 206 about fold line 350 to form a box-like structure that positions slots 360, 362 at an elevated position within the sleeve to engage the blister or node 400 of the blister card 104. Sleeve top panel 208 and sleeve reinforcing panel 300 are folded over interior panel 206 and the node retaining panels 340, 342, 344, 346 and may be attached to the node retaining panels. When folded, fold lines 296, 324 permit end members 292, 320 to be folded such that the walls 294, 322 of end members 292, 320 extend into and through the slots 290, 310. The opening 284 at least partially overlaps with slots 360, 362 to form a retaining slot towards the back of the sleeve defined by the housing 102.

Figure 11A:
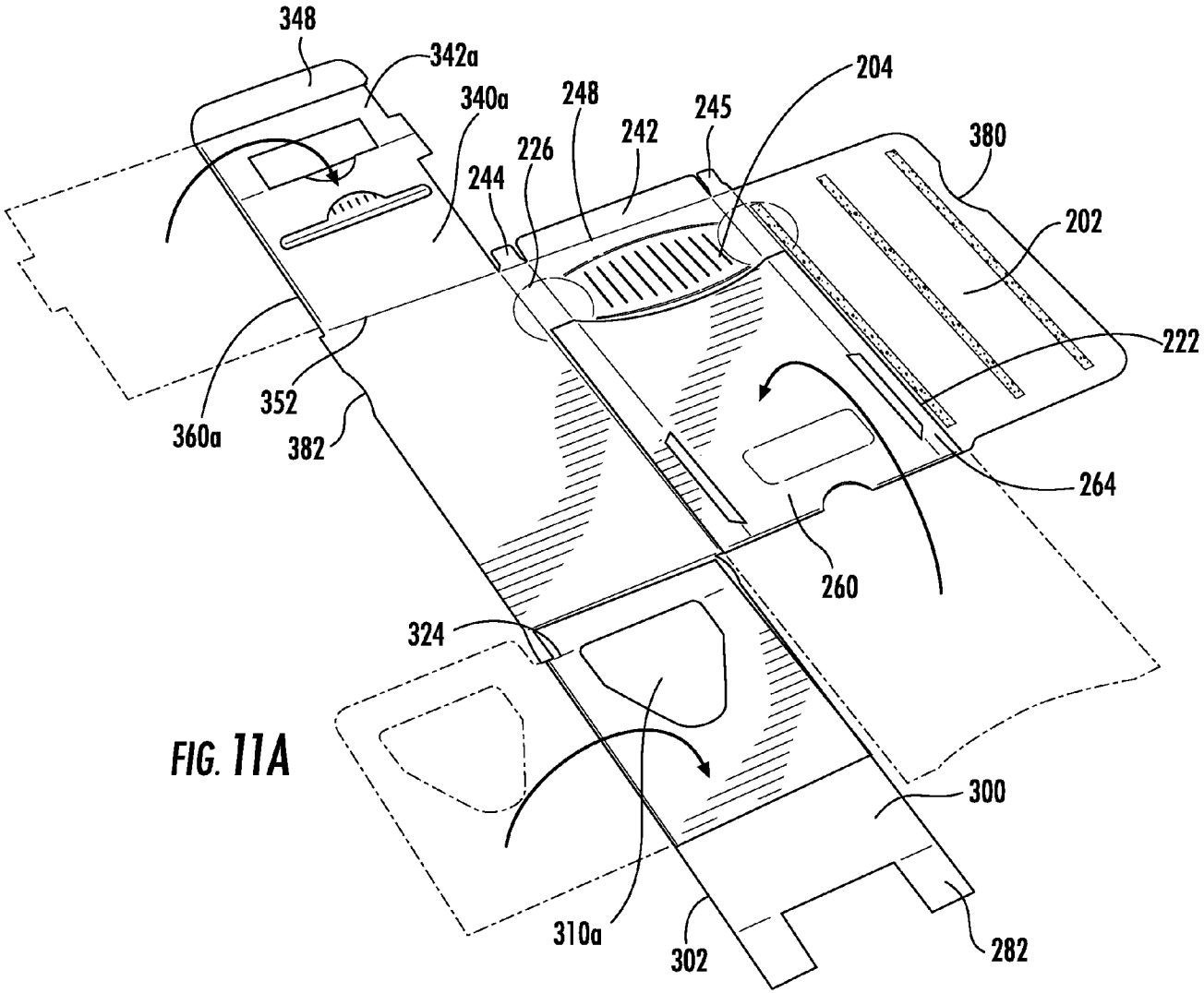
FIG. 11A is a top plan view of a second embodiment of the blank for the housing of the packaging container shown in FIG. 10 with the reinforcing panel folded onto the housing bottom panel and the sleeve reinforcing panel folded over the sleeve top panel, and the node retaining panels folded over upon themselves.
Figure 11B:
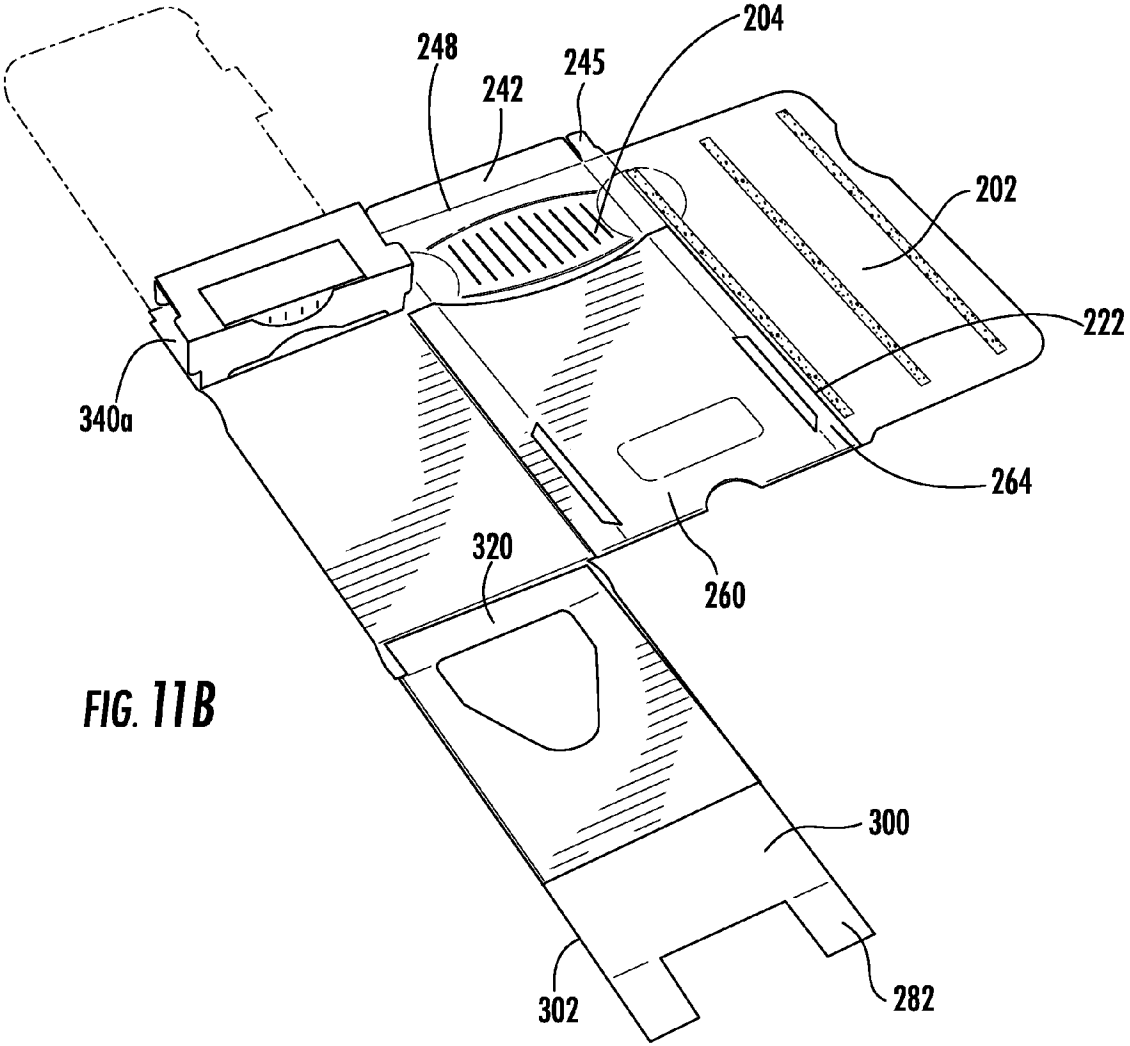
FIG. 11B is a top plan view of a second embodiment of the blank for the housing of the packaging container shown in FIG. 10 with the node retaining panels folded over the interior panel.
Figure 12:
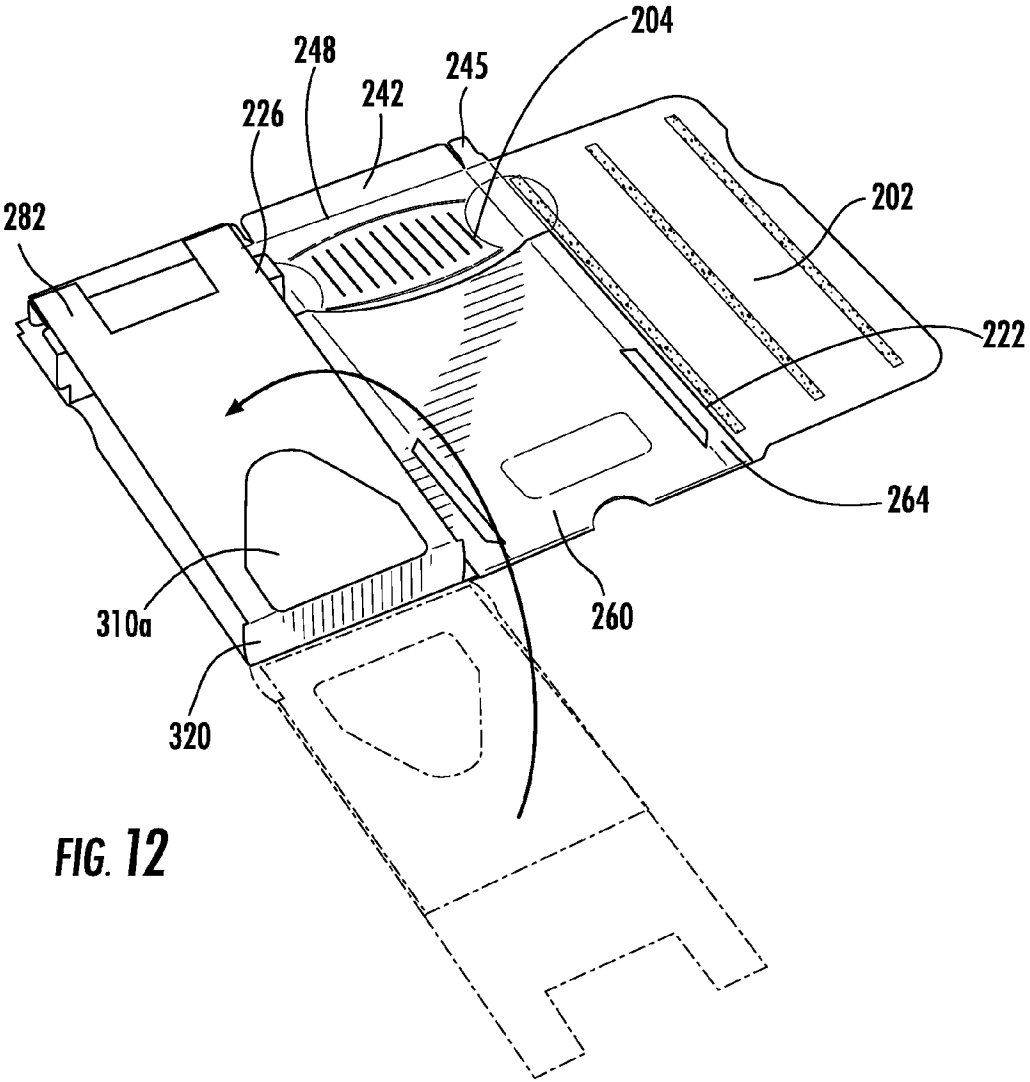
FIG. 12 is a top plan view of a second embodiment of the blank for the housing of the packaging container shown in FIG. 10 with the sleeve top panel folded over the interior panel and the node retaining panels.

Referring to FIGS. 10-11, it is appreciated that node retaining panels 340*a*, 342*a*, 344*a*, 346*a* may be attached to the end of interior panel 206 along fold line 352. Referring to FIG. 11A, panels 340*a*, 342*a* are folded over panels 344*a* and 346*a* about fold line 360*a* and attached using adhesives or other known means, if desired. The panels may then be folded about fold line 352 (see FIG. 11B), wherein panels 342*a*, 344*a* may then be folded back over panels 340*a*, 346*a* about fold lines 368*a* and 369*a* to form a box-like structure that positions slots 360*a*, 362*a* at an elevated position within the sleeve to engage the blister or node 400 of the blister card 104.

The interior panel 206 with the sleeve top panel 208, sleeve reinforcing panel 300 and node retaining panels 340, 342, 344, 346 are then folded over bottom panel 204 and reinforcing panel 260, with side panels 226 and 264 forming one side wall for the housing 102. Top panel 202 may then be folded about fold line 222 and attached to the back side of the interior panel 206 through adhesives 210 or other known means, wherein side panel 226 and side panel 264 form the other side to the housing 102. End panels 240, 242, 244 and 245 are folded about folding lines 246, 248, 250 and 252 and attached together to form a back end of the housing 102. Blister card 104 may then be inserted such that node 400 enters into the sleeve defined by the housing 102 and is moved until the node 400 engages slots 284, 360 and 362.

Referring to FIGS. 9 and 10, top panel 202 and interior panel 206 may include notches 380,382 that help to further define the regions on the housing for, and to facilitate the, squeezing of the sides of the housing to release the blister card 104.

It is further appreciated that the packaging container may also contain an electronic security device such as, but not limited to, a product sensor/transmitter that will set off an alarm to indicate that a consumer or customer may be passing a security sensor and thereby leaving the store with an unpurchased product. Such a sensor would be deactivated upon payment for the product at the point of purchase.

Figure 8:
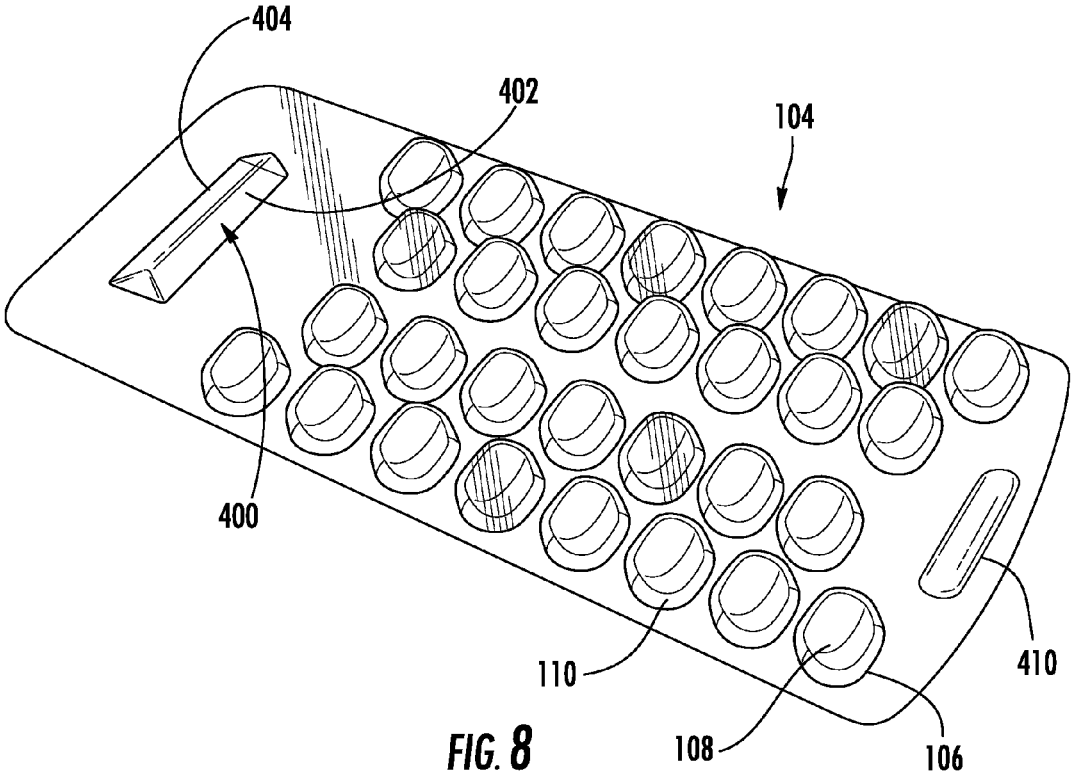
FIG. 8 is a top perspective view of a blister card for use with the housing shown in FIG. 1.

Referring to FIG. 8, one embodiment of a blister card 104 for use with the present invention is shown. The blister sheet or card 104 is made from a substantially rigid material such as, but not limited to, aluminum or plastic. The blisters 106, which are preferably transparent to permit the contents 108 to be viewed, include a chamber that extends outwardly and a rim about the bottom of the chamber that interacts with the blister card to secure the blister in place. While the blister pack is shown as having substantially thirty round blisters 106, it is appreciated that the blister pack may have any number of blisters of varying sized and shapes and not depart from the scope of the present invention. A plurality of dispensing slots are formed on the bottom of the blister card 104 and are covered with a thin film or foil sheet 110 so that the pills 108 contained in blisters can be pushed through.

One end of the blister card 104 includes a blister or node 400 that is sized and shaped to fit within slots and openings 284, 290, 310, 360 and 362 in the housing to retain the blister card 104 in a closed or stored position and an extended position. Referring again to FIG. 8, the node 400 may be rectangular in shape with a substantially flat or vertical front wall or side 402 and an angled back wall or side 404. The blister card 104 may have a blister 410 or other raised or textured surfaces or features at the other end to facilitate grasping of the blister card for removing it from the sleeve. It is appreciated that node 400 may be of a variety of sizes and shapes to fit within respective slots and not depart from the scope of the present invention.

Figure 7A:
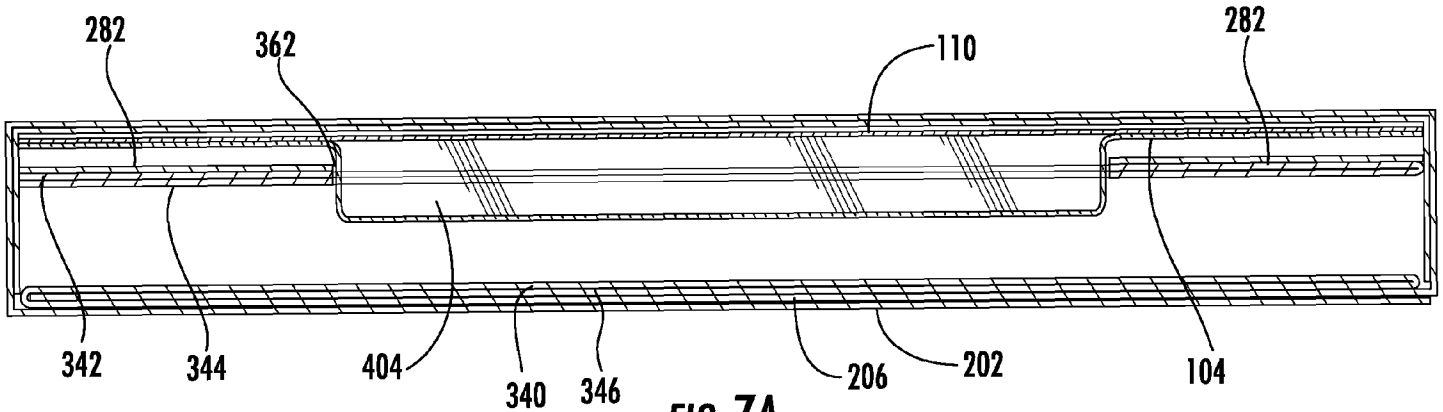
FIGS. 7A and 7B are partial views taken along the lines 7-7 of FIG. 1 showing the biasing of the housing, interior panel and retaining panels upon a squeezing action.
Figure 7B:
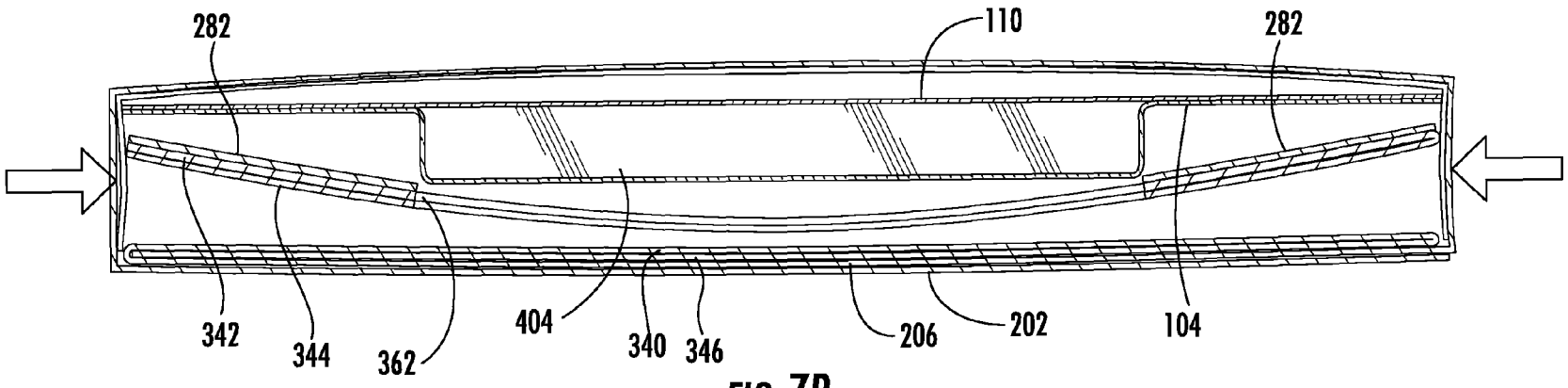

In operation, the blister card 104 is inserted into the opening at the end of the housing 102 and slid until the node 400 is biased into engagement with the slots 284, 342 and 344 of the sleeve top panel 204 and node retaining panels 342, 344, thereby limiting further axial movement of the blister card 104 relative to the housing 102. To release the blister card 104, a user squeezes the outer sides of the housing 102 about the slots 284, 342 and 344. Referring to FIG. 2, the housing 102 may include indicia or other indicators 232 to designate the proper area on the housing to be squeezed. As shown in FIGS. 7A and 7B, squeezing the sides acts to bias or bow the sleeve top panel 208 and node retaining panels 342, 344 downward (and the top panel 202 upward) such that the node 400 disengages or is released from containment by the slots 284, 342 and 344. The exposed end of the blister card 104 may then be grasped through semi-circular slot 270 about the open end of the housing 102 to withdraw the blister card 104 from the housing 102. The blister card 104 may then be slid and withdrawn from the housing until node 400 engages the slots 290, 310 on the sleeve top panel 208 and sleeve reinforcing panel 300, along with walls 294, 322, to prevent further withdrawal. Once the pill 108 is removed, the angled side 404 of the node 400 permits the node 400 to be pushed out of engagement with the slots 290, 310 when blister card 104 is pushed back into the packaging housing 102. The blister card 104 may be pushed until the node 400 engages the slots 284, 360, 362 so as to lock the blister card 104 in place.

It will be understood that modifications and variations may be effected without departing from the scope of the novel concepts of the present invention, but it is understood that this application is limited only by the scope of the appended claims.

The invention claimed is:

1. A packaging container comprising:

a housing having first and second sides, a top, a bottom, a back end and a front end defining a chamber and having an opening at the front end;

a panel inside the housing having: a left side, a right side, a central portion between the left and right sides and a first end with a slot proximate the first end about the central portion;

a blister sheet sized to move through the opening and having a first end and a second end, wherein the blister sheet includes a node proximate its first end adapted to engage the slot to retain the blister sheet within the housing when the blister sheet is in a stored position; and indicators on the housing proximate to the slot, wherein squeezing of the first and second sides of the housing at or proximate the indicators engages the left and right sides of the panel to bias the central portion of the panel outwardly and out of engagement with the node to permit lateral movement of the blister sheet within the chamber.

2. The packaging container of claim 1 wherein the panel is integral with the housing.

3. The packaging container of claim 1 wherein the panel has a second end and a second slot proximate the panel second end, wherein the node is adapted to engage the second slot to retain the blister sheet in an extended position.

4. The packaging container of claim 3 which further comprises a wall extending upwardly through the second slot to engage the node.

5. The packaging container of claim 1 wherein the housing is made from substantial tear resistant material.

6. The packaging container of claim 5 wherein the substantial tear resistant material is a SBS board coated with a polyethylene material.

7. The packaging container of claim 1 wherein the blister sheet includes a raised surface on its second end.

8. The packaging container of claim 1 wherein the housing is made from a printable material.

9. The packaging container of claim 1 wherein the housing is made from a paper product.

10. The packaging container of claim 1 wherein the housing further comprises an opening at its second end to facilitate grasping of the blister sheet in the stored position.

11. The packaging container of claim 1 wherein the node has an angled rear surface.

12. The packaging container of claim 1 wherein the housing further comprises node retaining panels folded over one another and located underneath the first end of the panel.

13. The packaging container of claim 12 wherein the node retaining panels include at least one slot that at least partially overlaps with the slot of the panel.

14. A packaging container comprising:

a housing having first and second sides, a top, a bottom, a back end and a front end defining a chamber and having an opening at the front end;

a panel inside the housing having: a left side, a right side, a central portion between the left and right sides, a first end with a slot proximate the first end about the central portion, a second end and a second slot proximate the second end about the central portion;

a blister sheet sized to move through the opening and having a first end and a second end, wherein the blister sheet includes a node proximate its first end adapted to engage the slot to retain the blister sheet within the housing when the blister sheet is in a stored position and adapted to engage the second slot to retain the blister sheet in an extended position, the node having an angled rear surface;

indicators on the housing proximate to the slot, wherein squeezing of the first and second sides of the housing at or proximate the indicators engages the left and right sides of the panel to bias the central portion of the panel outwardly and out of engagement with the node to permit lateral movement of the blister sheet within the chamber; and a wall extending upwardly through the second slot to engage the node.

15. The packaging container of claim 14 wherein the blister sheet includes a raised surface on its second end.

16. The packaging container of claim 14 wherein the housing further comprises node retaining panels folded over one another and located underneath the first end of the panel.

17. The packaging container of claim 14 wherein the node retaining panels include at least one slot that at least partially overlaps with the slot of the panel.

18. The packaging container of claim 14 wherein the housing further comprises node retaining panels folded over one another and located underneath the first end of the panel.

* * * * *